United States Patent [19]

Sapp

[11] 4,381,636

[45] May 3, 1983

[54] FRAMEWORK STRUCTURE

[75] Inventor: Dennis H. Sapp, Terre Haute, Ind.

[73] Assignee: Research-Cottrell, Inc., Chicago, Ill.

[21] Appl. No.: 214,019

[22] Filed: Dec. 8, 1980

[51] Int. Cl.[3] ..... E04B 5/14

[52] U.S. Cl. ..... 52/648; 403/171

[58] Field of Search ..... 52/648, DIG. 10, 797, 52/808, 645, 646; 428/178, 185; 403/171, 172, 176

[56] References Cited

U.S. PATENT DOCUMENTS

| | | | |
|---|---|---|---|
| 3,220,152 | 11/1965 | Sturm | 52/DIG. 10 |
| 3,642,566 | 2/1972 | Figge | 428/178 |
| 4,214,409 | 7/1980 | Gebhardt et al. | 52/648 |

FOREIGN PATENT DOCUMENTS

| | | | |
|---|---|---|---|
| 1501222 | 2/1953 | Australia | 52/808 |

*Primary Examiner*—James L. Ridgill, Jr.

*Attorney, Agent, or Firm*—Wegner, McCord, Wood & Dalton

[57] ABSTRACT

A framework structure defined by a first plurality of tetrahedral elements laterally juxtaposed in a first array and a second plurality of tetrahedral elements laterally juxtaposed in a second array, with the projecting apices of the first array received in the spaces between the projections of the second array and the projecting apices of the second array received in the spaces between the projections of the first array. In the illustrated embodiment, the bases of the tetrahedral elements of the first array define a common plane and the bases of the tetrahedral elements of the second array define a common plane extending parallel to the plane of the first array bases. The tetrahedral elements in the illustrated embodiment are formed of edge elements and corner connectors. The corner connectors are secured in interconnected association and, in the illustrated embodiment, the corner connectors are secured by connecting plates. The apices of the complementary array are also secured to the connecting plates to secure the two arrays in assembled association in the illustrated embodiment. The edge elements may be fixedly secured to the corner connectors. The connections between the tetrahedral elements are preferably removable so as to permit ready assembly and disassembly of the desired arrays, such as for use in forming a platform deck in a derrick construction or the like.

15 Claims, 6 Drawing Figures

FIG. 1
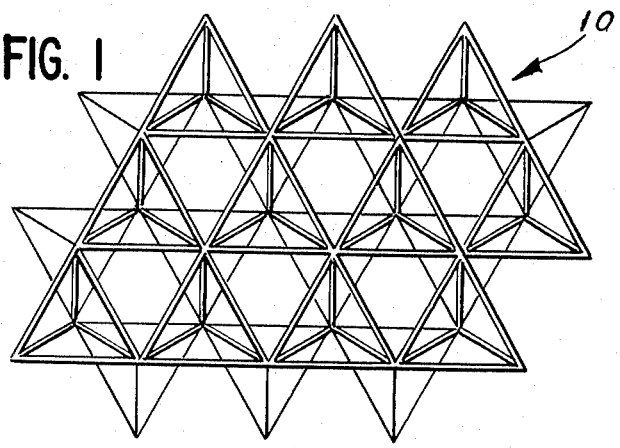
FIG. 2
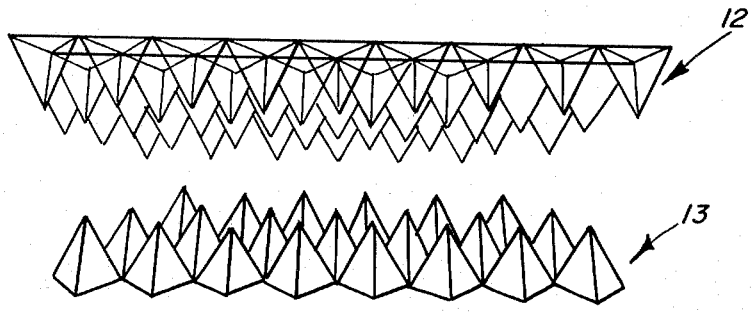
FIG. 3
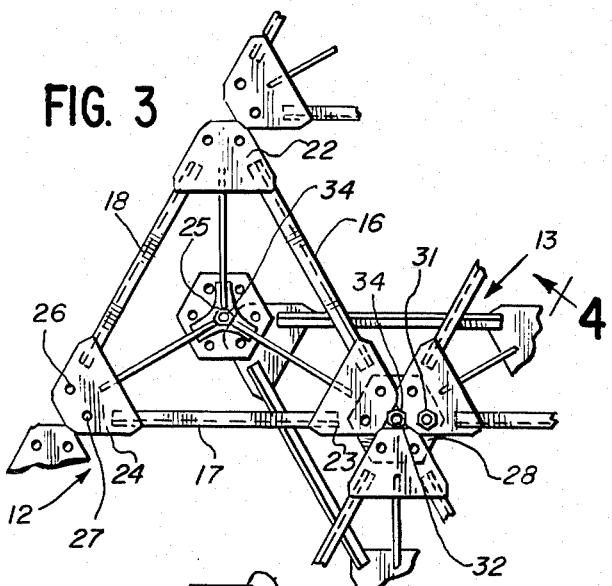
FIG. 5
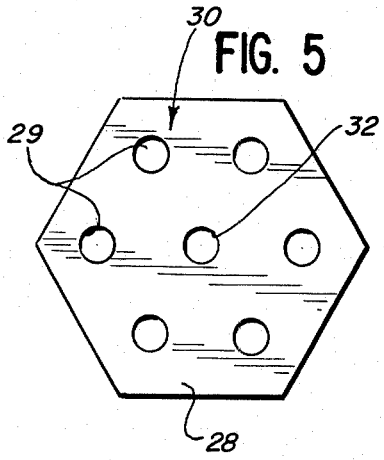
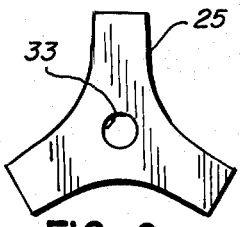
FIG. 6
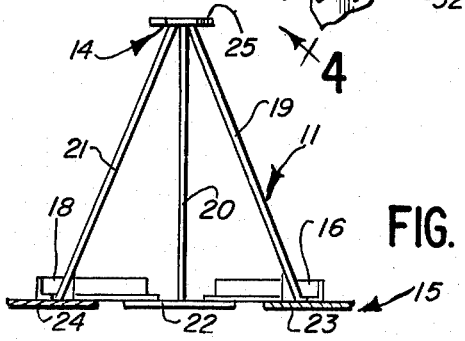
FIG. 4

FRAMEWORK STRUCTURE

BACKGROUND OF THE INVENTION

1. Field of the Invention

This invention relates to structural frameworks, and in particular to structural frameworks which may be readily assembled and disassembled, such as for use in derrick constructions.

2. Description of the Background Art

In constructing derricks, such as in building chimneys and the like, it is necessary to provide decks at different levels to provide work platforms. It is desirable that the decks be readily assembled and disassembled so as to permit them to be repositioned during the construction.

A number of different structure have been developed over the years for providing such decks. The structures of the prior art have had the disadvantages of complexity and difficulty of assembly and disassembly, and have not provided a fully satisfactory solution to the problem of providing such readily assembleable and disassembleable deck structures.

SUMMARY OF THE INVENTION

The present invention comprehends an improved framework structure which may be utilized as the deck of a derrick or the like and which is extremely simple and economical of construction while yet providing for facilitated assembly and disassembly.

More specifically, the present invention comprehends such a structure including a first plurality of tetrahedral elements each defining a hose and an apex, first securing means for securing the elements of the first plurality in a first array, with the bases thereof defining a first common plane and the apices thereof projecting perpendicularly thereto to define a plurality of tetrahedral projections narrowing away from the plane and a plurality of complementary first spaces therebetween widening away from the plane, a second plurality of tetrahedral elements each defining a base and an apex, and second securing means for securing the elements of the second plurality in a second array with the bases thereof defining a second common plane and the apices thereof projecting perpendicularly to the second common plane to define a plurality of tetrahedral projections narrowing away from the second common plane and a plurality of complementary second spaces therebetween widening away from the second common plane, the second array being nested with the first array with the projections of the first array received in the spaces of the second array and the projections of the second array received in the spaces of the first array with the planes of the bases of the second array being substantially parallel to the plane of the bases of the first array.

In the illustrated embodiment, the tetrahedral elements are formed of edge elements and corner connectors.

Third securing means may be provided for securing the connectors at the apices of the first array to the connectors of the bases of the second array and securing the connectors of the apices of the second array to the connectors of the bases of the first array.

The structure is adapted for use as a deck framework, having means defining a first array of laterally juxtaposed tetrahedral projections, means defining a second array of laterally juxtaposed tetrahedral projections, and means for securing the arrays together with the projection of each array received in the spaces between the projection of the other array.

The tetrahedral elements of the arrays may be secured to each other by connector plates and means for securing the connector plates to the corner connectors of the bases of the tetrahedral elements.

The tetrahedral elements may be secured in association with each other by removable securing means, such as threaded means, to permit facilitated assembly and disassembly of the arrays as desired.

Thus, the framework structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary plan view of a framework structure embodying the invention;

FIG. 2 is a fragmentary perspective view illustrating the arrangement of the tetrahedral elements in first and second opposed arrays prior to the internesting thereof in forming the structure of FIG. 1;

FIG. 3 is a fragmentary top plan view of the interconnected arrangement of the arrays of FIG. 2;

FIG. 4 is a fragmentary section taken substantially along the line 4—4 of FIG. 3;

FIG. 5 is a plan view of a connector plate for use in securing the tetrahedral elements in lateral association in the arrays; and FIG. 6 is a plan view of a corner connector for use in connecting the edge elements of the tetrahedral elements at the apices thereof.

DESCRIPTION OF THE PREFERRED EMBODIMENT

In the exemplary embodiment of the invention as disclosed in the drawing, a framework structure generally designated 10 is shown for use such as in a derrick deck. Structure 10 is made up of a plurality of tetrahedral elements generally designated 11 removably secured in lateral association to define a pair of arrays generally designated 12 and 13, as shown in FIG. 2. Where the structure is intended to define a horizontal deck framework, the array 12 comprises an upper array and the array 13 comprises a lower array.

The invention comprehends the internesting of the tetrahedral elements of one array with the tetrahedral elements of the other array so as to define a framework structure having a thickness substantially equal to the altitude of the individual tetrahedral elements. Thus, more specifically, the apices generally designated 14 of the respective tetrahedral elements project into the complementary tetrahedral spaces between the tetrahedral elements of the opposing array in the internested association.

In the exemplary embodiment, each tetrahedral element is defined by a base generally designated 15. The tetrahedral element may be made up of a plurality of base edge elements 16, 17 and 18, and a plurality of projecting edge elements 19, 20 and 21, which converge upwardly from base 15 to define the apex 14, as illustrated in FIG. 4.

The base edge elements 16, 17 and 18 are connected at the corners of the base 15 by base connectors 22, 23 and 24. The converging ends of the projecting edge elements 19, 20 and 21 are connected by an apex connector 25.

In the illustrated embodiment, the base edge elements comprise angle irons and the projecting edge elements comprise rods. In the illustrated embodiment, the ends of the edge elements are secured to the corner connectors by suitable means, such as welding.

As best seen in FIG. 3, each of the base connectors is provided with a pair of openings 26 and 27. As indicated above, the tetrahedral elements 11 are removably secured in the desired laterally extending array by a plurality of connector plates 28. As shown in FIG. 5, each connector plate is provided with six base connector openings 29 arranged in a hexagonal array so as to define three pairs of base connector openings generally designated 30. Each pair 30 is arranged to be aligned with the openings 27 of the base connector to permit securing of the base connector to the connector plate by suitable removable means, such as threaded nuts and bolts generally designated 31, as seen in FIG. 3, extended through the aligned openings. Thus the connector plate 28 and the nut and bolt means 31 define first securing means for securing the tetrahedral elements in the interconnected array 12 and second securing means for securing the tetrahedral elements in the interconnected array 13.

As further shown in FIG. 5, each connector plate is provided with a central opening 32. As further shown in FIG. 6, the apex connector 25 is provided with a central opening 33. When the arrays 12 and 13 are internested, as illustrated in FIGS. 1 and 3, the apex connectors 25 are juxtaposed to the connector plates 28 of the opposing array, with the openings 33 of the apex connectors aligned with the openings 32 of the base connector plates of the opposing array. The thusly juxtaposed apex connectors and connector plates are removably secured together by suitable means, such as threaded nut and bolt means 34, as shown in FIG. 3 to define third securing means for the juxtaposed connectors 25, and 28 of the respective arrays 12 and 13.

As further illustrated in FIG. 3, the corner connectors 22, 23 and 24 are generally trapezoidal so as to permit access to the central opening 32 of the connector plate 28 in connecting the opposing apex connector 25 thereto, as discussed above.

The tetrahedral elements 11 may be performed and provided to the construction site in suitable quantities to form the desired supporting structures. As indicated above, each of the tetrahedral elements is arranged to be connected to associated tetrahedral elements in forming an array thereof by use of the connector plates 28 and securing means 31. As further indicated above, the arrays 12 and 13 may be removably secured in the internested arrangement by the removable securing means 34 cooperating with the apex connectors 25 and connector plates 28 of the respective arrays. Thus, the framework structure 10 may be readily assembled from the component tetrahedral elements 11 in any suitable desired laterally extending configuration.

In the illustrated embodiment, the base connectors 22, 23 and 24 are coplanar and, thus, the bases of each of the arrays 12 and 13 are substantially planar. When the arrays 12 and 13 are secured in internested relationship, the bases thereof extend in parallel planes. Thus, the plane of the upper surface of the array 12 may define a deck surface on which suitable flooring may be placed to provide a platform for the workers in the construction operation.

The arrays 12 may be readily disassembled by simple removal of the respective securing elements 31 and 34 for reuse of the tetrahedral elements as desired.

As will be obvious to those skilled in the art, other configurations of the base edge elements and projecting edge elements, as well as configurations of the respective corner connectors and connecting plates, may be utilized within the scope of the invention. In the broad aspect, the invention comprehends the provision of such a framework structure comprised of means defining a first array of lateally juxtaposed tetrahedral projections and means defining a second array of laterally juxtaposed tetrahedral projections, with means for securing the arrays together with the projections of each array received in the spaces between the projections of the other array. The invention further comprehends the provision of means when desired to secure the two arrays in the internested arrangement.

The novel structure permits ready assembly and disassembly of the component parts thereof for facilitated use in temporary construction structures and the like, and this, is advantageously adaptable for use in construction derricks and the like.

The foregoing disclosure of specific embodiments is illustrative of the broad inventive concepts comprehended by the invention.

I claim:

1. A structure comprising:

a first plurality of tetrahedral elements each defining a base and an apex and formed of edge elements and corner connectors one each at each corner of the element base;

first securing means for removably securing the corner connectors of the bases of said elements in a first array with said bases thereof defining a first common plane and the apices thereof projecting perpendicularly thereto to define a plurality of of tetrahedral projections narrowing away from said plane and a plurality of complementary first spaces therebetween widening away from said plane;

a second plurality of tetrahedral elements each defining a base and an apex and formed of edge elements and corner connectors;

second securing means for removably securing the elements of said second plurality in a second array with the bases thereof defining a second common plane and the apices thereof projecting perpendicularly to said second common plane to define a plurality of tetrahedral projections narrowing away from said second common plane and a plurality of complementary second spaces therebetween widening away from said second common plane, said second array being nested with said first array with the projections of said first array received in said spaces of the second array and the projections of said second array received in said spaces of the first array with the planes of the bases of said second array being substantially parallel to the plane of the bases of said first array; and third securing means for removably securing the connectors at the apices of the first array to the connectors of the bases of the second array, and the connectors at the basis of the first array to the connectors at the apices of the second array, the corner connectors at the apex of the elements being secured by said third securing means to corner connectors at a corner of the base of each of three elements nested therewith.

2. The structure of claim 10 wherein each said tetrahedral element defines isosceles triangular faces.

3. The structure of claim 1 wherein said tetrahedral elements comprise elongated edge elements connected to said corner connectors to define an open framework.

4. The structure of claim 1 wherein said tetrahedral elements comprise elongated edge elements connected to said corner connectors to define an open framework, said corner connectors being connected to corner connectors of adjacent tetrahedral elements by threaded securing means.

5. The structure of claim 1 wherein the edge elements comprise the corner connectors of the base of the tetrahedral element comprising angle irons.

6. The structure of claim 1 wherein said tetrahedral elements comprise elongated edge elements and corner connectors arranged to define an open framework, the edge elements connecting the corner connectors of the base to the corner connector defining the apex of the tetrahedral element comprising rods.

7. The structure of claim 1 wherein said corner connectors comprise flat plates.

8. The structure of claim 1 wherein said corner connectors comprise flat plates having apertures for receiving removable securing elements.

9. The structure of claim 1 wherein said third securing means includes portions of said first and second securing means.

10. The structure of claim 1 wherein said third securing means includes portions of said first and second securing means and means for removably securing said portions in interconnected association.

11. The structure of claim 1 wherein said first and second securing means comprise connecting plates secured to said base connectors of the first and second arrays and said third securing means includes portions of said first and second securing means connecting plates.

12. The structure of claim 1 wherein said arrays extend horizontally and the bases of the elements of said first array define a common top plane for supporting a floor.

13. The structure of claim 1 wherein each of said securing means comprises threaded securing means whereby said arrays may be readily assembled and disassembled as desired.

14. The structure of claim 1 wherein said edge elements are welded to said corner connectors.

15. The structure of claim 1 wherein, said third securing means comprise connector plates and threaded securing means for removably securing the connector plates to the corner connectors at the bases of the projections to selectively interconnect the tetrahedral elements.

* * * * *